US009083076B2

(12) United States Patent
Parsche

(10) Patent No.: US 9,083,076 B2
(45) Date of Patent: Jul. 14, 2015

(54) DIPOLE ANTENNA ASSEMBLY HAVING AN ELECTRICAL CONDUCTOR EXTENDING THROUGH TUBULAR SEGMENTS AND RELATED METHODS

(71) Applicant: Harris Corporation, Melbourne, FL (US)

(72) Inventor: Francis E. Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 349 days.

(21) Appl. No.: 13/782,317

(22) Filed: Mar. 1, 2013

(65) Prior Publication Data

US 2014/0247193 A1 Sep. 4, 2014

(51) Int. Cl.

| | |
|---|---|
| ***H01Q 9/04*** | (2006.01) |
| ***H01Q 9/28*** | (2006.01) |
| ***H01Q 9/20*** | (2006.01) |
| ***H01Q 9/16*** | (2006.01) |
| ***H01Q 9/22*** | (2006.01) |
| ***H01Q 5/321*** | (2015.01) |
| ***H01Q 5/47*** | (2015.01) |
| ***H01Q 5/48*** | (2015.01) |

(52) U.S. Cl.

CPC ..... *H01Q 9/28* (2013.01); *H01Q 5/321* (2015.01); *H01Q 5/47* (2015.01); *H01Q 5/48* (2015.01); *H01Q 9/16* (2013.01); *H01Q 9/20* (2013.01); *H01Q 9/22* (2013.01); *Y10T 29/49016* (2015.01)

(58) Field of Classification Search

USPC ..... 343/792

See application file for complete search history.

(56) References Cited

U.S. PATENT DOCUMENTS

| | | | |
|---|---|---|---|
| 4,352,109 | A | 9/1982 | Reynolds et al. |
| 6,483,471 | B1 | 11/2002 | Petros |
| 7,064,728 | B1 | 6/2006 | Lin et al. |
| 8,081,130 | B2 | 12/2011 | Apostolos et al. |
| 2007/0139289 | A1 | 6/2007 | Lee et al. |

*Primary Examiner* — Graham Smith

(74) *Attorney, Agent, or Firm* — Allen, Dyer, Doppelt, Milbrath & Gilchrist, P.A.

(57) ABSTRACT

A dipole antenna assembly may include a first tubular dipole element and a coaxial antenna feed extending through a proximal end of the first tubular dipole element. The coaxial antenna feed may have an inner conductor, an outer conductor, and a dielectric therebetween. The inner conductor may extend outwardly beyond a distal end of the first tubular dipole element. The outer conductor may be coupled to the distal end of the first tubular dipole element. The dipole antenna assembly may further include a second tubular dipole element with a proximal end being adjacent the distal end of the first tubular dipole element, and being coupled to the inner conductor. The second tubular dipole element may include first and second tubular segments and an electrical conductor extending through the first and second tubular sections and being coupled thereto at both the proximal and distal ends.

21 Claims, 8 Drawing Sheets

DIPOLE ANTENNA ASSEMBLY HAVING AN ELECTRICAL CONDUCTOR EXTENDING THROUGH TUBULAR SEGMENTS AND RELATED METHODS

FIELD OF THE INVENTION

The present invention relates to the field of antennas and, more particularly, to dipole antennas and related methods.

BACKGROUND OF THE INVENTION

Antennas may be used for a variety of purposes, such as for wireless communications devices including broadcast receivers, pagers, two-way radios, or radio location devices ("ID tags"). The cellular telephone is an example of a wireless communications device, which is nearly ubiquitous. A relatively small size, increased efficiency, and a relatively broad radiation pattern are generally desired characteristics of an antenna for a portable radio or wireless device. It may be desirable for an antenna to communicate at a given frequency with desired characteristics, such as bandwidth, polarization, or gain pattern. Omnidirectional antennas, radiating a circular shaped pattern about the horizon may be preferred as they reduce the need for antenna orientation or aiming.

One particularly popular type of antenna is a dipole antenna. A dipole antenna is a radio antenna that includes a center-fed driven element. Two conductors (e.g. rods or wire) are oriented collinear with each other (in line with each other), with a small space between them. Radio frequency (RF) voltage is applied to the antenna at the center, between the two conductors. The half power or 3 dB gain bandwidth of a thin wire (diameter $<\lambda/50$) half wave dipole antenna may be about 13.5 percent, the 2 to 1 voltage standing wave ratio (VSWR) bandwidth about 4.5 percent, and the loaded circuit Q about 14.8, which may not be adequate. Realized gain versus frequency plots are typically quadratic in shape near the half wave dipole resonance. VSWR response is also quadratic.

To achieve desired antenna characteristics, the size and shape of an antenna, for example, of a dipole antenna may be adjusted. U.S. Pat. No. 4,352,109 to Reynolds et al. discloses an inner end-supportable, center driven dipole antenna having a two part outer or upper element or rod. The antenna is supported at its lower or inner end to be vertical or at an angle thereto. The rod is fixed by a clamp so that the upper element has the length of ⅝ wavelength. The upper element is connected to an inner or lower element portion of a conductive support mast. The lower element or pole also has a length of ⅝ wavelength so that the total length of the dipole is 1¼ wavelengths. The dipole connecting arrangement includes an impedance matching network. The rods are conductors. The lower end of one rod is flared to fit within a conical portion of a dielectric support and extends upwardly through a cylindrical opening in which it is snugly fitted so as to be watertight.

U.S. Pat. No. 6,483,471 to Petros discloses a sleeve dipole. A tubular dipole includes a coaxial cable, an inner conductor, and a balun with the quarter-wave metal sleeve. The inner conductor extends from the top of the balun and is coupled to a quarter-wave hollow metal tube. In one embodiment, a multiple tubular dipole antenna includes comprises a coaxial cable having an inner conductor and an outer conductor both running vertically and concentrically through a quarter-wave metal sleeve. The antenna further includes a shorted end formed from the connection of the outer conductor of the coaxial cable to an end of the quarter-wave metal sleeve. Additionally, a quarter-wave hollow metal tube is connected to the inner conductor of the coaxial cable extending from the end of the quarter-wave metal sleeve. An additional dipole antenna is configured substantially concentrically above the quarter-wave hollow metal tube using another quarter-wave metal sleeve and a hollow metal tube. The antenna also includes a shorted end formed from the connection of the outer conductor of the coaxial cable to an end of the quarter-wave metal sleeve. The hollow metal tube is connected to the inner conductor of the coaxial cable extending from the end of the quarter-wave metal sleeve.

U.S. Pat. No. 8,081,130 to Apostolos et al. is directed to a broadband whip antenna. More particularly, Apostolos et al. discloses a shortened multi-band antenna that includes in-line dipoles, selected elements of which having shielded meanderline chokes to be able to switch from an extended dipole at the lower VHF frequencies to a shortened dipole for the UHF band.

Referring to FIG. 1, a prior art dipole antenna 120 is now described. The antenna 120 may be configured to achieve a bandwidth gain of four. A coaxial antenna feed 140 extends through a second tubular dipole element 150 having a proximal end 151 and an opposing distal end 152. The second tubular dipole element 150 includes first and second spaced apart tubular segments 153, 154 aligned in spaced apart relation. The coaxial antenna feed 140 includes an inner conductor 141, an outer conductor 142, and a dielectric 143 therebetween. The outer conductor 142 of the coaxial antenna feed 140 is coupled to the proximal and distal ends 151, 152 of the second dipole element 150. The inner conductor 141 extends outwardly from the distal end 152 of the second tubular dipole element 154 and couples to a first tubular dipole element 130 at a proximal end 131.

Further improvements to dipole antennas may be desired. For example, it may be particularly desirable to increase ease of assembly while maintaining an increased frequency response.

SUMMARY OF THE INVENTION

In view of the foregoing background, it is therefore an object of the present invention to provide a dipole antenna that has an increased frequency response, for example, bandwidth with respect to gain and VSWR, and that may be relatively easy to assemble.

This and other objects, features, and advantages in accordance with the present invention are provided by a dipole antenna assembly that includes a first tubular dipole element having opposing proximal and distal ends. The dipole antenna assembly includes a coaxial antenna feed extending through the proximal end of the first tubular dipole element. The coaxial antenna feed has an inner conductor, an outer conductor, and a dielectric therebetween. The inner conductor extends outwardly beyond the distal end of the first tubular dipole element, and the outer conductor is coupled to the distal end of the first tubular dipole element to define a first antenna feedpoint.

A second tubular dipole element has opposing proximal and distal ends, with the proximal end being adjacent the distal end of the first tubular dipole element and being coupled to the inner conductor to define a second antenna feedpoint. The second tubular dipole element includes first and second tubular segments aligned in spaced apart relation, and an electrical conductor extending through the first and second tubular sections and being coupled thereto at both the proximal and distal ends.

The outer conductor of the coaxial antenna feed may be spaced apart from adjacent interior portions of the first tubular dipole element. The electrical conductor may be spaced apart from adjacent interior portions of the first and second tubular segments, for example.

A method aspect is directed to a method of making a dipole antenna assembly. The method includes providing a first tubular dipole element having opposing proximal and distal ends. The method further includes positioning a coaxial antenna feed through the proximal end of the first tubular dipole element. Positioning the coaxial antenna feed includes positioning includes a dielectric between an inner conductor and an outer conductor. The inner conductor is positioned to extend outwardly beyond the distal end of the first tubular dipole element and to couple to the distal end of the first tubular dipole element to define a first antenna feedpoint. The method further includes positioning a second tubular dipole element having opposing proximal and distal ends with the proximal end being adjacent the distal end of the first tubular dipole element and with the proximal end being coupled to the inner conductor to define a second antenna feedpoint. Positioning the second tubular dipole element includes positioning first and second tubular segments to be aligned in spaced apart relation, and positioning an electrical conductor to extend through the first and second tubular sections, and to couple to the first and second tubular segments at both the proximal and distal ends.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 2:
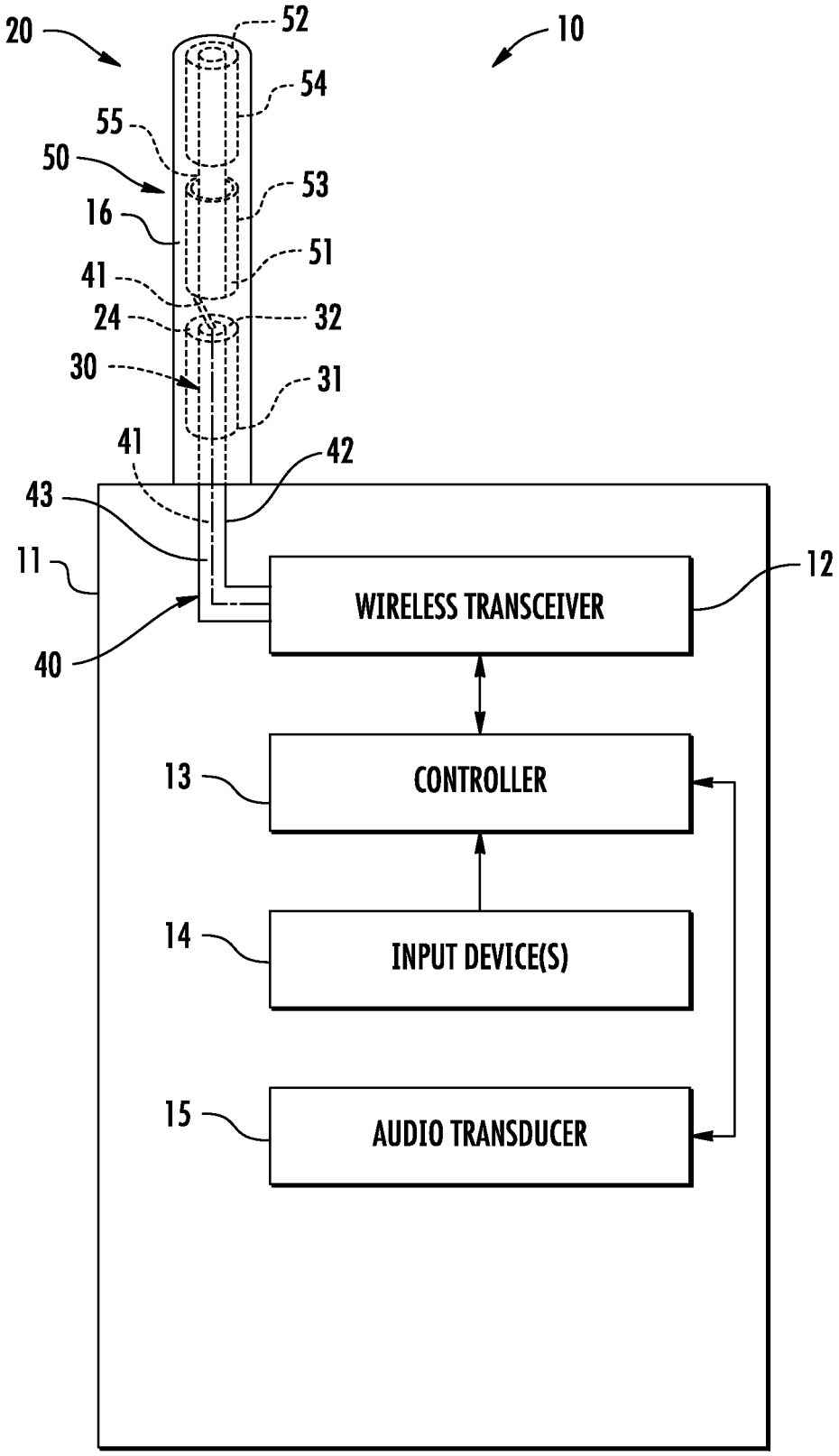
FIG. 2 is a schematic diagram of an electronic device including a dipole antenna assembly in accordance with the present invention.

Referring initially to FIG. 2, a mobile wireless communications device 10 includes a portable housing 11 and a wireless transceiver 12 carried by the portable housing. The mobile wireless communications device 10 may be a cellular communications device or a two-way radio, for example. Of course, the mobile wireless communications device 10 may be another type of communications device or mounting platform. A dipole antenna assembly 20 is coupled to the wireless transceiver 12 and is carried by the portable housing 11. The mobile wireless communications device 10 further includes a controller 13, or processor, one or more input devices 14 coupled to the controller, and an audio transducer 15 also coupled to the controller. The controller 13 cooperates with the wireless communications circuitry to perform a wireless communications function, for example, voice and/or data. Of course other or additional components may be carried by the portable housing 11 and coupled to the controller 13.

Figure 3:
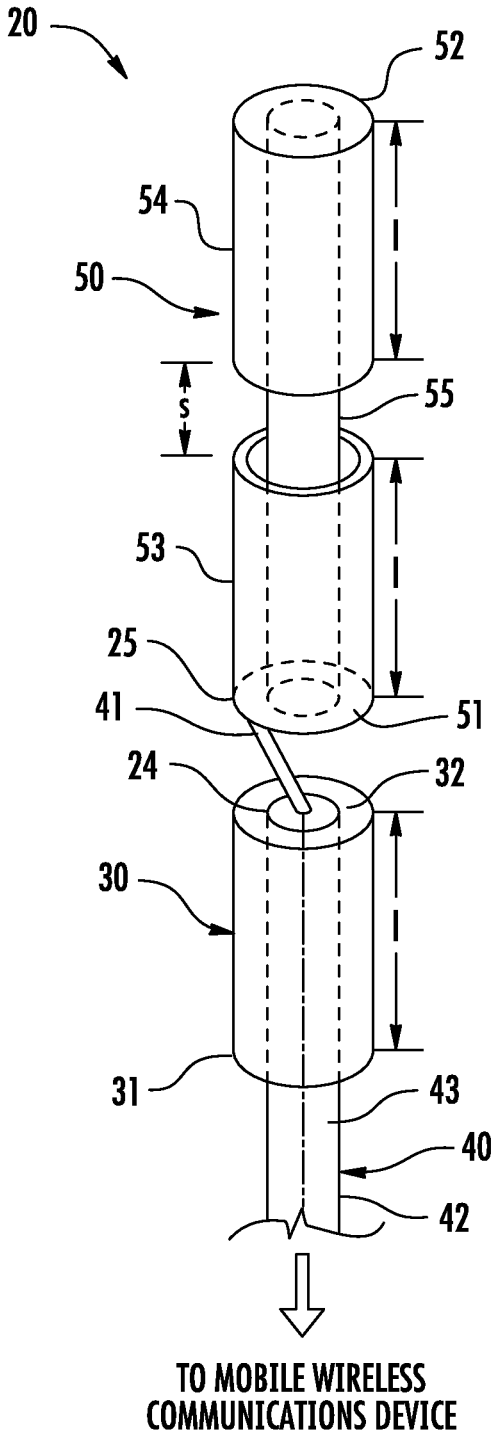
FIG. 3 is an enlarged schematic diagram of a portion of the dipole antenna assembly of FIG. 2.

Referring now additionally to FIG. 3, the dipole antenna assembly 20 includes a first tubular dipole element 30 which acts as the lower half dipole element. The first tubular dipole element 30 is electrically conductive and may be metal. For example, the first tubular dipole element 30 may be a metal sleeve. The first tubular dipole element 30 has a proximal end 31 and a distal end 32 opposite from the proximal end. The opening at the distal end 32 is sized so that it is smaller relative to the openings at the proximal end 31. In some embodiments, the openings at the proximal and distal ends 31, 32 may be sized the same or have a different relative sizing.

Additionally, the first tubular dipole element 30 preferentially has a desired operating frequency in the ultra high frequency (UHF) range between 300 and 3000 MHz, for example. Thus the present embodiments may be particularly advantageous as a thin whip antenna for use at UHF. It should be understood however that the dipole antenna assembly 20 is not limited to this frequency range, for example, the usable frequencies may be adjusted by scaling the physical size of the dipole antenna and its components. A length l of the first tubular dipole element 30 may correspond to +/−10% of a quarter of a wavelength of the desired operating frequency, for example. A fatter tubular dipole element 30 may be slightly shorter and thinner one slightly longer. Of course, the first tubular dipole element 30 may have a length corresponding to other desired electrical characteristics, such as harmonic resonances.

The dipole antenna assembly 20 also includes a coaxial antenna feed 40 extending concentrically through the first tubular dipole element 30. More particularly, the coaxial antenna feed 40 is spaced apart from adjacent interior portions of the first tubular dipole element 30. The coaxial antenna feed 40 has an inner conductor 41, an outer conductor 42, and a dielectric therebetween 43. The inner conductor 41 extends outwardly beyond the distal end 32 of the first tubular dipole element 30. The distal end 32 of the first tubular dipole element 30, as noted above, is sized relatively smaller than the proximal end 31, and is also sized to allow the inner conductor 41 to pass therethrough. As will be appreciated by those skilled in the art the coaxial antenna feed 40 together with the first tubular dipole element 30 form a "coaxial cable over a coaxial cable." The first tubular dipole element 30 acts as both an antenna half element and a balun choke.

The outer conductor 42 is coupled to the distal end 32 of the first tubular dipole element 30 to define a first antenna feedpoint 24. The relative sizing of the opening at the distal end 32, as being smaller than the opening at the proximal end 31, advantageously provides an increased coupling area for the outer conductor 42 to define the first antenna feedpoint 24.

The dipole antenna assembly 20 further includes a second tubular dipole element 50 aligned in spaced apart relation from the first tubular dipole element 30. The second tubular dipole element 50 is illustratively longitudinally aligned with the first tubular dipole element 30. Of course, in some embodiments, the first and second dipole elements 30, 50 may not be longitudinally aligned.

The second tubular dipole element 50 has a proximal end 51 adjacent the distal end 32 of the first tubular dipole element 30. The proximal end 51 is coupled to the inner conductor 41 to define a second antenna feedpoint 25. The second tubular dipole element 50 also has a distal end 52 opposite the proximal end 51.

The second tubular dipole element 50 includes first and second tubular segments 53, 54 longitudinally aligned in spaced apart relation. The first and second tubular segments 53, 54 act as the upper half of the dipole element. The first and second tubular segments 53, 54 may be metal sleeves, for example. The proximal end 51 of the second tubular dipole element 50, i.e., an end of the first spaced apart tubular segment 53, is illustratively closed. In some embodiments, the proximal end 51 may be open. The distal end 52 of the second tubular dipole element 50, i.e., an end of the second spaced apart tubular segment 54, is also illustratively closed. In some embodiments, the distal end 52 may be open. Similar to the first tubular dipole element 30, each of the first and second tubular segments 53, 54 of the second tubular dipole element 50 may be sized to have a length l corresponding to +/−10% of a quarter of a wavelength of the desired operating frequency, for example. Of course, each of the first and second tubular segments 53, 54 may have a length l corresponding to other desired electrical characteristics. An electrical conductor 55 extends through the first and second spaced apart tubular sections 53, 54 and is coupled to the closed proximal and distal ends 51, 52. The electrical conductor 55 is spaced apart from adjacent interior portions of the first and second tubular sections 53, 54. The electrical conductor 55 is in the form of an electrically conductive rod, and may include metal, for example. Of course the electrical conductor 55 may be another type of conductor and may be in another shape, for example.

The first and second spaced apart tubular sections 53, 54 are spaced apart by a distance S. The coupling of the filter poles, the bandpass ripple, and the bandwidth of the dipole antenna assembly 20 is determined by the spacing S. More particularly, the spacing S determines the spacing of the gain peaks and the voltage standing wave ratio (VSWR) dips, for example. As will be appreciated by those skilled in the art, the second tubular dipole element 50 causes the double tuning. Advantageously, the dipole antenna assembly 20 provides dual band operation, where the bandwidth and ripple are adjusted by via the spacing S. In some embodiments, the spacing distance S may have a length corresponding to +/−10% of a twentieth of a wavelength of the desired operating frequency.

A second control on the inter-element coupling may be provided by making the first tubular sections 53 and the first tubular dipole element 30 unequal in length. This results in looser coupling to the lower dipole and increased driving point impedance, and increased influence from the second spaced apart tubular section 54.

Figure 4A:
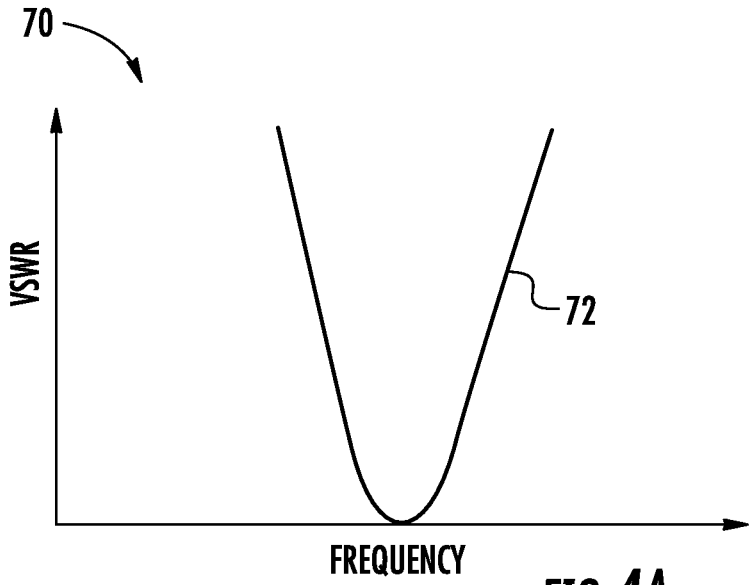
FIG. 4A PRIOR ART
FIG. 4*a* is a graph of frequency response versus gain and voltage standing wave ratio for a dipole antenna assembly in accordance with the prior art.
Figure 4B:
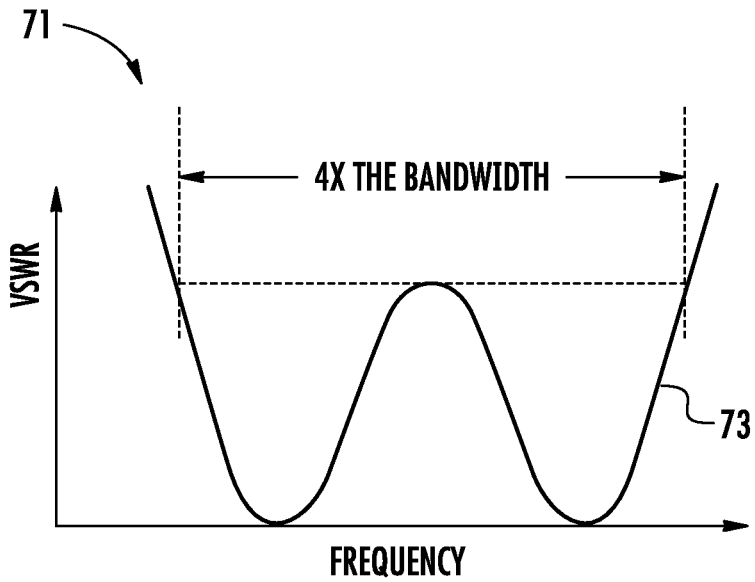
FIG. 4*b* is a graph of frequency response versus gain and voltage standing wave ratio for a dipole antenna assembly in accordance with the present invention.

Referring now to the graphs 70 and 71 in FIGS. 4*a* and 4*b*, respectively, compared to a single sleeve dipole (i.e., a second tubular dipole element having a single tubular segment), which has a quadratic single tuned frequency response 72, the dipole antenna assembly 20 has a frequency response 73 that may be four times the bandwidth of the single sleeve dipole. The frequency response is a $4^{th}$ order Chebyschev or double tuned frequency response, as the responses of each of the first and second tubular dipole elements 30, 50 become staggered and combined. The plotted quantities in graphs 70 and 71 in FIGS. 4*a* and 4*b* are of respective voltage stranding wave ratios (VSWR), which are dimensionless, versus radio frequency in Hertz. The gain response with frequency (not shown) is similar but reciprocal. That is, the gain response has peaks where the VSWR response has dips.

Figure 5:
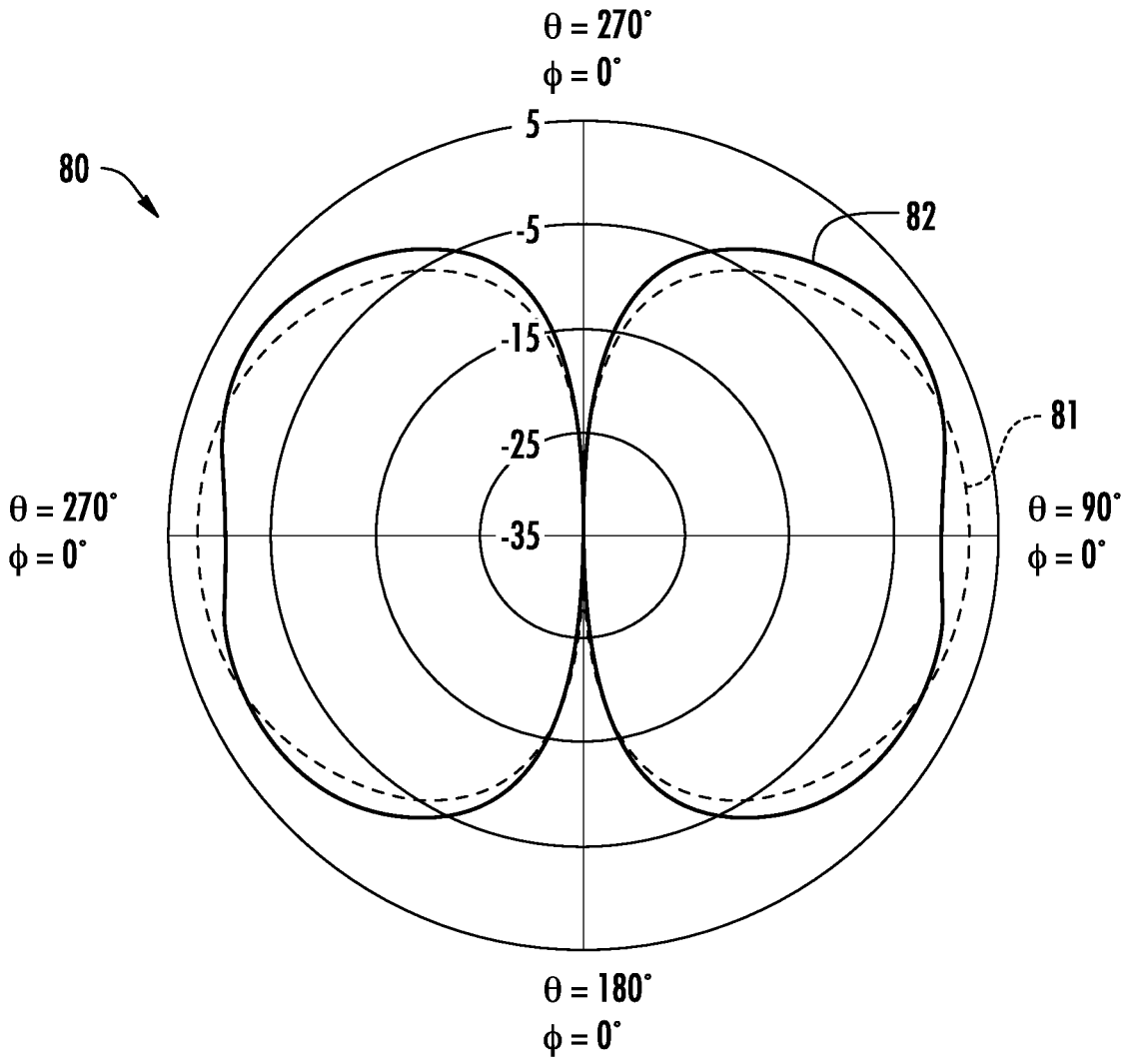
FIG. 5 is a graph of a calculated elevation radiation pattern of a dipole antenna assembly in accordance with the present invention and a reference dipole.

Referring now to the graph 80 in FIG. 5, calculated far field elevation cut radiation patterns are illustrated. The line or curve 81 plots the radiation pattern of the dipole antenna assembly 20 and line or curve 82 plots the function 10 LOG ($\cos^2 \theta$), e.g. the canonical response of a ½ wave thin wire dipole. The two radiation patterns 81, 82 have a similar two petal rose shape. However, the dipole antenna assembly 20 advantageously has a broader, 124° half power beamwidth, compared to the reference wave dipole 88° half power beamwidth, which may be particularly advantageous for portable applications where the antenna is not aimed or oriented. The units represented in the graph 80 are dBil or decibels with respect to an isotropic radiator and for linear polarization. The directivity of the dipole antenna assembly 20 is +1.6 dBil. Voltage standing wave ratio (VSWR) of the physical prototype was measured to be 1.2 to 1 in a 50 ohm system at the VSWR minima, of which there were two.

Figure 6:
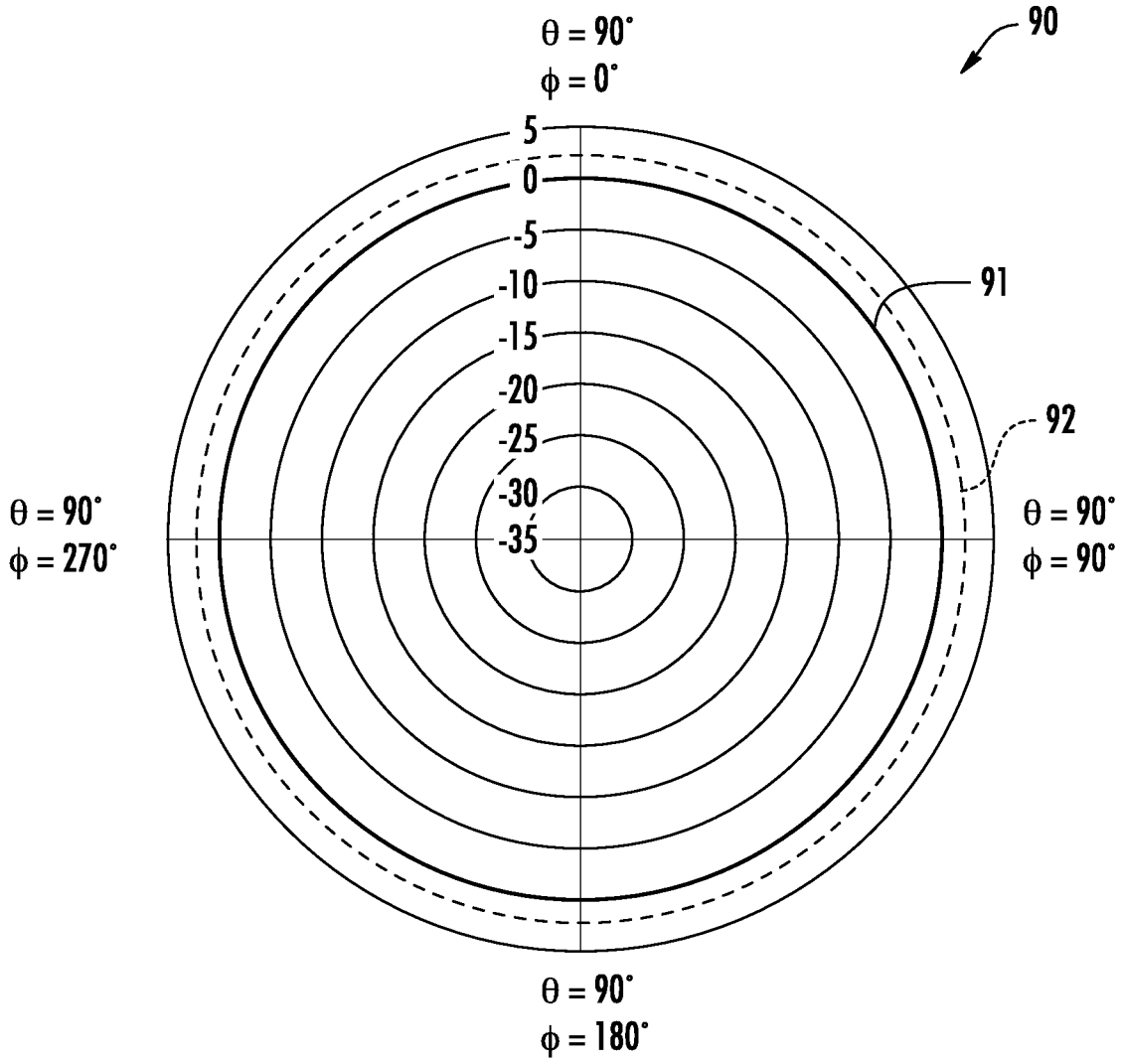
FIG. 6 is a graph of a calculated azimuth plane radiation pattern of a dipole antenna assembly in accordance with the present invention and a reference dipole.

Referring now to the graph 90 in FIG. 6, the far field azimuth cut radiation pattern of the dipole antenna assembly 20 is illustrated by line 91. The line 92 depicts the 10 LOG ($\cos^2 \theta$) shaped response of a canonical wave thin wire dipole and is included for reference. The dipole antenna assembly 20 has a circular or omni-directional radiation pattern in azimuth which may reduce the need for antenna aiming, for example. The polarization of the dipole antenna assembly 20 is vertical linear when the antenna is vertically oriented.

Additionally, the dipole antenna assembly 20 may include a dielectric covering 16 surrounding the first and second dipole elements 30, 50 (FIG. 2). For example, the first and second dipole elements 30, 50 may be encased or embedded within a rubber molding, which may allow the dipole antenna assembly 20 to be particularly useful as a whip antenna for the mobile wireless communications device 10. In other embodiments, the dipole antenna assembly 20 may be included within another type of molding, for example fiberglass, which may be particularly useful as a probe type aircraft antenna, for example, extending outwardly from the aircraft tail.

A physical prototype was built based upon the dipole antenna assembly 20. The prototype dipole antenna assembly was constructed of RG-316 coaxial cable using rolled copper foil sleeves for the first and second dipole elements. The antenna length was 12.5 inches or 0.89λ and the center frequency of operation was 846 MHz at the ripple center. The antenna diameter was 0.3 inches including a urethane rubber encapsulation molded over the antenna, so the prototype was in the form of a flexible whip type antenna. The first and second tubular segments and the second tubular dipole element were all the same length.

The physical prototype had a measured realized gain of −0.5 dBil including the coaxial cable transmission line losses. The 3 dB gain bandwidth was 31.8 percent, so an increase in bandwidth of $[(31.8-13.5)/13.5]\times100=136$ percent over a conventional half wave thin wire dipole was realized. The VSWR ripple level of the prototype was adjusted to be 6 to 1. As background, a 6 to 1 VSWR corresponds approximately to a 3 dB mismatch loss, and this VSWR level may be useful in portable products to allow for antennas of a relatively small size. Of course, the VSWR level dipole antenna assembly may be adjusted to any desired level with a trade in bandwidth and ripple.

Figure 7:
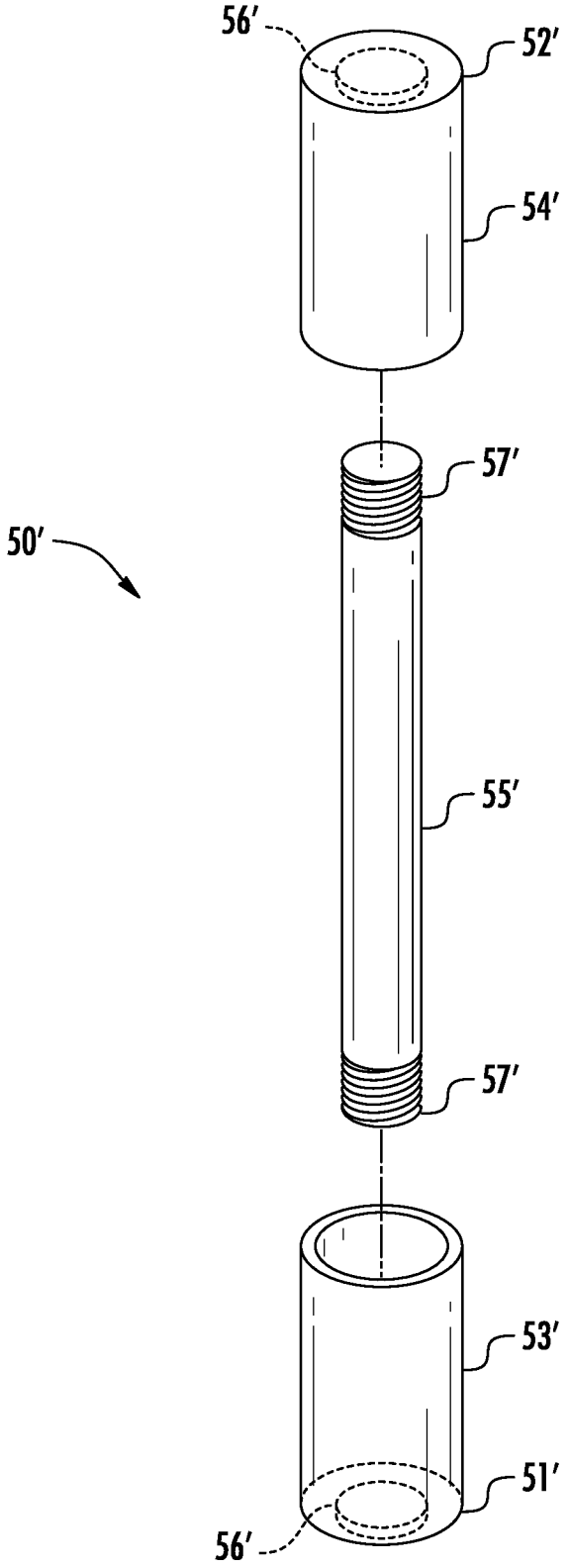
FIG. 7 is a schematic diagram of a second tubular dipole element of a dipole antenna assembly according to another embodiment of the present invention.

Referring now to FIG. 7, in another embodiment, the second tubular dipole element 50' includes threads 56' at the closed proximal and distal ends 51', 52'. The electrical conductor 55' also has threads 57' at the opposing ends for coupling with the threads at 56' at the closed proximal and distal ends 51', 52'. The threads 56', 57' may further increase ease of assembly of the dipole antenna assembly 20.

Figure 8:
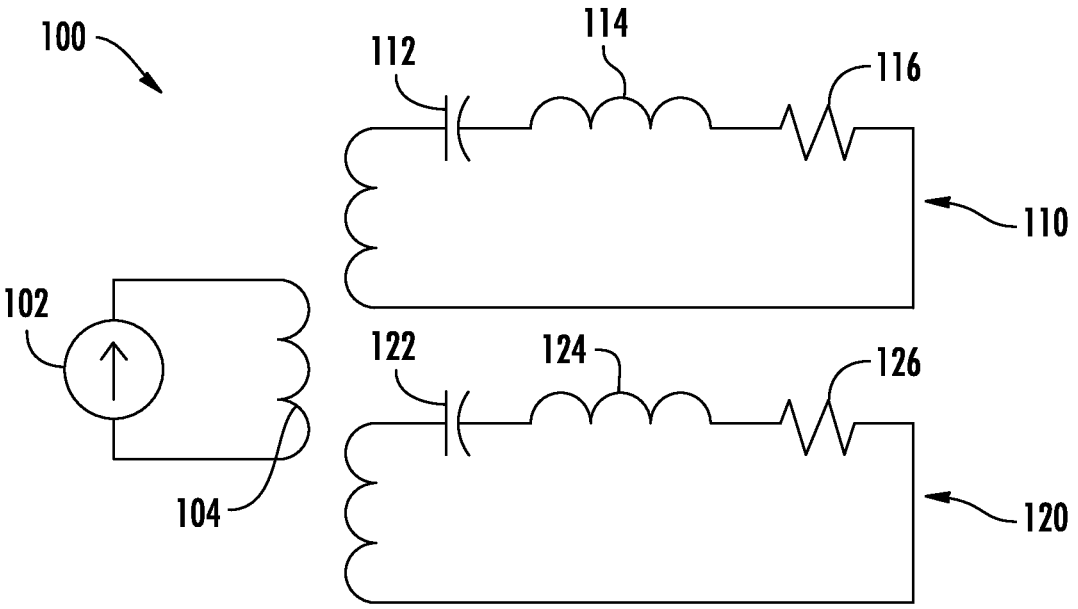
FIG. 8 is a circuit equivalent model of a dipole antenna assembly in accordance with the present invention.

Referring to FIG. 8, a circuit equivalent model 100 of the dipole antenna assembly 20 will now be described. As background, a circuit equivalent model represents the electrical behavior of a device, so it is understood that the components illustrated in the model 100 may or may not be present physically in the conventional sense. In the circuit equivalent model 100 the RF current source 102 is coupled in a transformer like fashion to two series resonant circuits 110, 120. The first series resonant circuit 110 represents, together, the first tubular dipole element 30 and the first tubular segment 53, e.g. the series resonance circuit 110 represents a center fed coaxial sleeve dipole comprised of the lower two sleeves. The second series resonant circuit 120 represents the second tubular segment 54, and it may function as a resonator to force a double tuned Chebyschev frequency response. A resistor 116 represents the resistance of a half wave dipole at resonance which may be about 73 ohms. The capacitor 112 and the inductor 114 represent the stray capacitance between the first tubular dipole element 30 and the first tubular segment 53 and the self-inductance of the first tubular dipole element and the first tubular segment. These cancel each other at the fundamental/half wave resonance, which is a preferred frequency of operation for the dipole antenna assembly 20.

The resistor 126 represents the radiation resistance developed by the second tubular segment 54 and the value of that resistance may be about 10 to 30 ohms. The capacitor 122 and the inductor 124 represent the reactive aspects of the second tubular segment 54 and may include the effects of the ¼ wave coaxial stub formed by the combination of the second tubular segment and the electrical conductor 55. Variable coupling 130 is based upon the proximity of the first tubular segment 53 to the second tubular segment 54, and the variable coupling 130 coupling coefficient is controlled by adjusting the dimension S denoted in FIG. 3. Thus, adjusting dimension S is similar to varying the coefficient of coupling of a transformer secondary to a transformer primary.

Series resonant circuits 110, 120 each may have a quadratic response near fundamental resonance, but when proportionately combined by the transformer 104 a double tuned Chebyschev frequency response results coupling two quadratic responses together causes double tuning. The series resonant circuits 110, 120 may individually have identical resonant frequencies, and the double tuning accomplished, and this may be a preferred mode of operation. Of course, the series resonant circuits 110, 120 may individually have different resonant frequencies, say for dual band operation of the dipole antenna assembly 20 or otherwise.

A method aspect is directed to a method of making a dipole antenna assembly 20. The method includes providing a first tubular dipole element 30 having opposing proximal and distal ends 31, 32. The method further includes positioning a coaxial antenna feed 40 through the proximal end 31 of the first tubular dipole element 30. Positioning the coaxial antenna feed 40 includes positioning dielectric 43 between an inner conductor 41 and an outer conductor 42. The inner conductor 41 is positioned to extend outwardly beyond the distal end 32 of the first tubular dipole element 30 and couples to the distal end 32 of the first tubular dipole element 30 to define a first antenna feedpoint 24. The method further includes positioning a second tubular dipole element 50 having opposing proximal and distal ends 51, 52 with the proximal end being adjacent the distal end 32 of the first tubular dipole element 30 and with the proximal end being coupled to the inner conductor 41 to define a second antenna feedpoint 25. The second tubular dipole element 50 includes first and second tubular segments 53, 54 aligned in spaced apart relation, and an electrical conductor 55 extending through the first and second tubular sections. The electrical conductor 55 is coupled to the first and second tubular sections 54, 55 at both the proximal and distal ends 51, 52.

Figure 1:
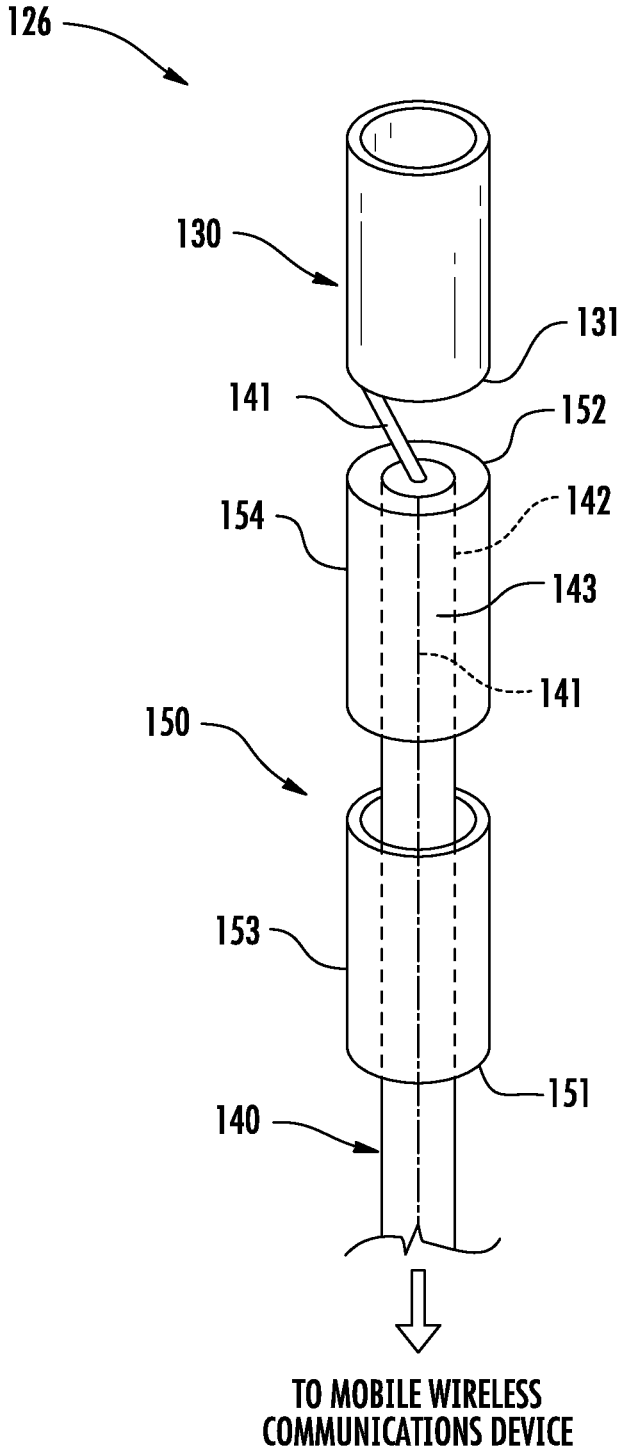
FIG. 1 PRIOR ART
FIG. 1 is a schematic diagram of a dipole antenna assembly in accordance with the prior art.

The dipole antenna assembly 20 may be particularly advantageous, for example, in comparison to the prior art dipole antenna 120 described above with respect to FIG. 1. More particularly, the dipole antenna assembly 20 allows for increased convenience of assembly. In contrast with the dipole antenna 120 in FIG. 1, the coaxial antenna feed 40 of the dipole antenna assembly 20 of the present embodiments does not have to be fed through two tubular sleeves. Moreover, the dipole antenna assembly 20 has increased common mode choke impedance. The dipole antenna assembly 20 may further have decreased current flow over the coaxial antenna feed 40 toward the user or the wireless transceiver 12, which may be undesirable.

Another method aspect increases the multiple tuning to achieve a desired bandwidth. More particularly, the dipole antenna assembly 20 may include a plurality of second tubular segments 54. In other words the method may include extending the length of the antenna assembly 20 by adding additional second tubular segments 54 to increase the order of the polynomial tuning, to increase the number of ripples in the frequency response, and to increase the realized bandwidth. An infinite number of second tubular segments 54 may result in infinite order Chebyschev polynomial tuning and $3\pi$ times the bandwidth of an ordinary single tuned dipole.

A fundamental limit on 3 dB gain bandwidth extension for thin wire half wave dipoles (diameter $<\lambda/50$) may exist as $3\pi(13.5\%)=127\%$, as the ripple of the Chebyschev polynomial becomes compressed towards the upper part of the passband with increasing polynomial order. The paper "The Wide-Band Matching Area for a Small Antenna", H. Wheeler, IEEE Transactions On Antennas and Propagation, Vol. AP-31, No. 2 March, 1983 may be consulted in this regard. Within the fundamental limitations, the present method provides for increasing bandwidth. Thus the natural quadratic response of dipole is modified by second tubular segments 54 to become a forced Chebyschev response for increased bandwidth. With respect to the antenna assembly 20, the dipole radiating structure is but one pole or zero of many poles or zeros in a radiating Chebyschev filter.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A dipole antenna assembly comprising:

a first tubular dipole element having opposing proximal and distal ends;

a coaxial antenna feed extending through the proximal end of said first tubular dipole element and comprising an inner conductor, an outer conductor, and a dielectric therebetween, said inner conductor extending outwardly beyond the distal end of said first tubular dipole element, said outer conductor coupled to the distal end of said first tubular dipole element to define a first antenna feedpoint; and a second tubular dipole element having opposing proximal and distal ends, with the proximal end being adjacent the distal end of said first tubular dipole element and being coupled to said inner conductor to define a second antenna feedpoint;

said second tubular dipole element comprising first and second tubular segments aligned in spaced apart relation, and an electrical conductor extending through said first and second tubular sections and being coupled thereto at both the proximal and distal ends.

2. The dipole antenna assembly according to claim 1, wherein said outer conductor of said coaxial antenna feed is spaced apart from adjacent interior portions of said first tubular dipole element; and wherein said electrical conductor is spaced apart from adjacent interior portions of said first and second tubular segments.

3. The dipole antenna assembly according to claim 1, wherein said first and second tubular dipole elements have a desired operating frequency; and wherein said first tubular dipole element has a length corresponding to +/−10% of a quarter of a wavelength of the desired operating frequency.

4. The dipole antenna assembly according to claim 1, wherein said first and second tubular dipole elements have a desired operating frequency; and wherein each of said first and second tubular segments has a length corresponding to +/−10% of a quarter of a wavelength of the desired operating frequency.

5. The dipole antenna assembly according to claim 1, wherein said first and second tubular dipole elements have a desired operating frequency; and wherein a spacing between said first and second tubular segments has a length corresponding to +/−10% of a twentieth of a wavelength of the desired operating frequency.

6. The dipole antenna assembly according to claim 1, wherein said first and second tubular dipole elements are longitudinally aligned.

7. The dipole antenna assembly according to claim 1, wherein said first and second tubular segments are longitudinally aligned.

8. The dipole antenna assembly according to claim 1, wherein the proximal and distal ends of said second tubular dipole each comprises a closed end.

9. The dipole antenna assembly according to claim 1, further comprising a dielectric covering surrounding said first and second dipole elements.

10. A mobile wireless communications device comprising:

a portable housing;

a wireless transceiver carried by said portable housing; and a dipole antenna assembly carried by said portable housing and coupled to said wireless transceiver, said dipole antenna assembly comprising a first tubular dipole element having opposing proximal and distal ends, a coaxial antenna feed extending through the proximal end of said first tubular dipole element and comprising an inner conductor, an outer conductor, and a dielectric therebetween, said inner conductor extending outwardly beyond the distal end of said first tubular dipole element, said outer conductor coupled to the distal end of said first tubular dipole element to define a first antenna feedpoint, and a second tubular dipole element having opposing proximal and distal ends, with the proximal end being adjacent the distal end of said first tubular dipole element and being coupled to said inner conductor to define a second antenna feedpoint, said second tubular dipole element comprising first and second tubular segments aligned in spaced apart relation, and an electrical conductor extending through said first and second tubular sections and being coupled thereto at both the proximal and distal ends.

11. The mobile wireless communications device according to claim 10, wherein said outer conductor of said coaxial antenna feed is spaced apart from adjacent interior portions of said first tubular dipole element; and wherein said electrical conductor is spaced apart from adjacent interior portions of said first and second tubular segments.

12. The mobile wireless communications device according to claim 10, wherein said first and second tubular dipole elements have a desired operating frequency; and wherein said first tubular dipole element has a length corresponding to +/−10% of a quarter of a wavelength of the desired operating frequency.

13. The mobile wireless communications device according to claim 10, wherein said first and second tubular dipole elements have a desired operating frequency; and wherein each of said first and second tubular segments has a length corresponding to +/−10% of a quarter of a wavelength of the desired operating frequency.

14. The mobile wireless communications device according to claim 10, wherein said first and second tubular dipole elements have a desired operating frequency; and wherein a spacing between said first and second tubular segments has a length corresponding to +/−10% of a twentieth of a wavelength of the desired operating frequency.

15. The mobile wireless communications device according to claim 10, wherein said first and second tubular dipole elements are longitudinally aligned.

16. The mobile wireless communications device according to claim 10, wherein said first and second tubular segments are longitudinally aligned.

17. A method of making a dipole antenna assembly comprising:

providing a first tubular dipole element having opposing proximal and distal ends;

positioning a coaxial antenna feed through the proximal end of the first tubular dipole element, positioning the coaxial antenna feed comprising positioning a dielectric between an inner conductor and an outer conductor, the inner conductor being positioned to extend outwardly beyond the distal end of the first tubular dipole element and couple to the distal end of the first tubular dipole element to define a first antenna feedpoint; and positioning a second tubular dipole element having opposing proximal and distal ends with the proximal end being adjacent the distal end of the first tubular dipole element and with the proximal end being coupled to the inner conductor to define a second antenna feedpoint, positioning the second tubular dipole element comprising positioning first and second tubular segments to be aligned in spaced apart relation, and positioning an electrical conductor to extend through the first and second tubular sections and to couple thereto at both the proximal and distal ends.

18. The method according to claim 17, wherein positioning the coaxial antenna feed comprises positioning the outer conductor to be spaced apart from adjacent interior portions of the first tubular dipole element; and wherein positioning the second tubular dipole element comprising positioning the second tubular dipole element so that the electrical conductor is spaced apart from adjacent interior portions of the first and second tubular segments.

19. The method according to claim 17, wherein the first and second tubular dipole elements have a desired operating frequency; and wherein the first tubular dipole element is provided to have a length corresponding to +/−10% of a quarter of a wavelength of the desired operating frequency.

20. The method according to claim 17, wherein the first and second tubular dipole elements have a desired operating frequency; and wherein each of the first and second tubular segments is provided to have a length corresponding to +/−10% of a quarter of a wavelength of the desired operating frequency.

21. The method according to claim 17, wherein the first and second tubular dipole elements have a desired operating frequency; and wherein the second tubular dipole element is positioned with a spacing between the first and second tubular segments having a length corresponding to +/−10% of a twentieth of a wavelength of the desired operating frequency.

* * * * *